US005896822A

United States Patent [19]

Futamura

[11] Patent Number: 5,896,822

[45] Date of Patent: Apr. 27, 1999

[54] EMBROIDERY DATA PROCESSING DEVICE

[75] Inventor: Masao Futamura, Nagoya, Japan

[73] Assignee: Brother Kogyo Kabushiki Kaisha, Aichi-Ken, Japan

[21] Appl. No.: 08/943,870

[22] Filed: Oct. 8, 1997

[30] Foreign Application Priority Data

Oct. 9, 1996 [JP] Japan ..... 8-268302

[51] Int. Cl.[6] ..... D05C 5/02

[52] U.S. Cl. ..... 112/102.5; 112/475.19

[58] Field of Search ..... 112/102.5, 470.04, 112/470.06, 454, 445, 475.19; 364/470.09, 470.08

[56] References Cited

U.S. PATENT DOCUMENTS 5,386,789 2/1995 Futamura et al. ..... 112/102.5
5,558,031 9/1996 Muto et al. ..... 112/102.5
5,701,830 12/1997 Muto ..... 112/102.5

FOREIGN PATENT DOCUMENTS 60-42740 9/1985 Japan .

*Primary Examiner*—Peter Nerbun
*Attorney, Agent, or Firm*—Kane, Dalsimer, Sullivan, Kurucz, Levy, Eisele and Richard, LLP

[57] ABSTRACT

Provided is a method of editing embroidery data indicative of an embroidering area. According to the method, an embroidery area is displayed together with at least one sub-area which is included in the embroidery area. By designating a sub-area, a displayed condition of the sub-area is switched to another displayed condition. Further, simultaneously with the change of the displayed condition, a sewing condition assigned to the sub-area is changed to another sewing condition.

20 Claims, 5 Drawing Sheets

FIG. 3
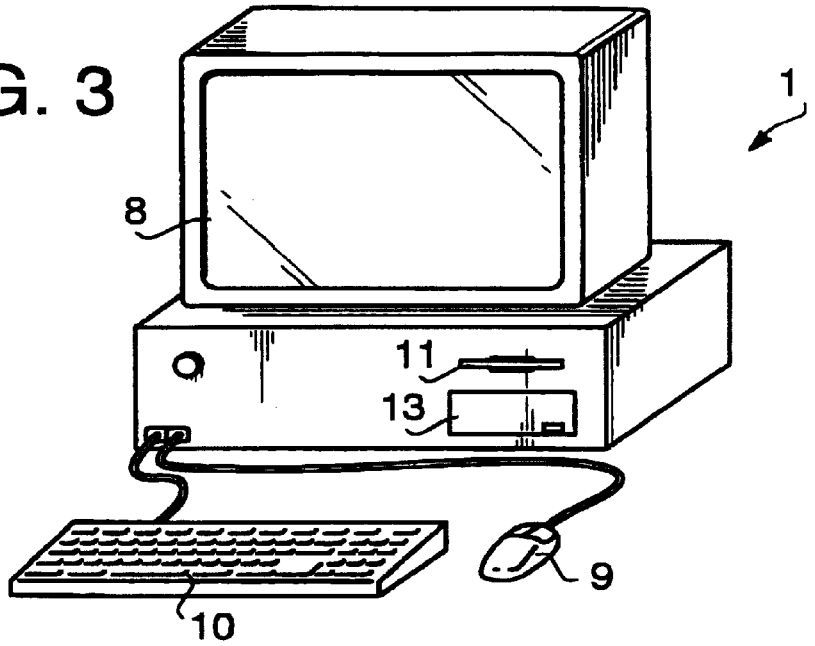
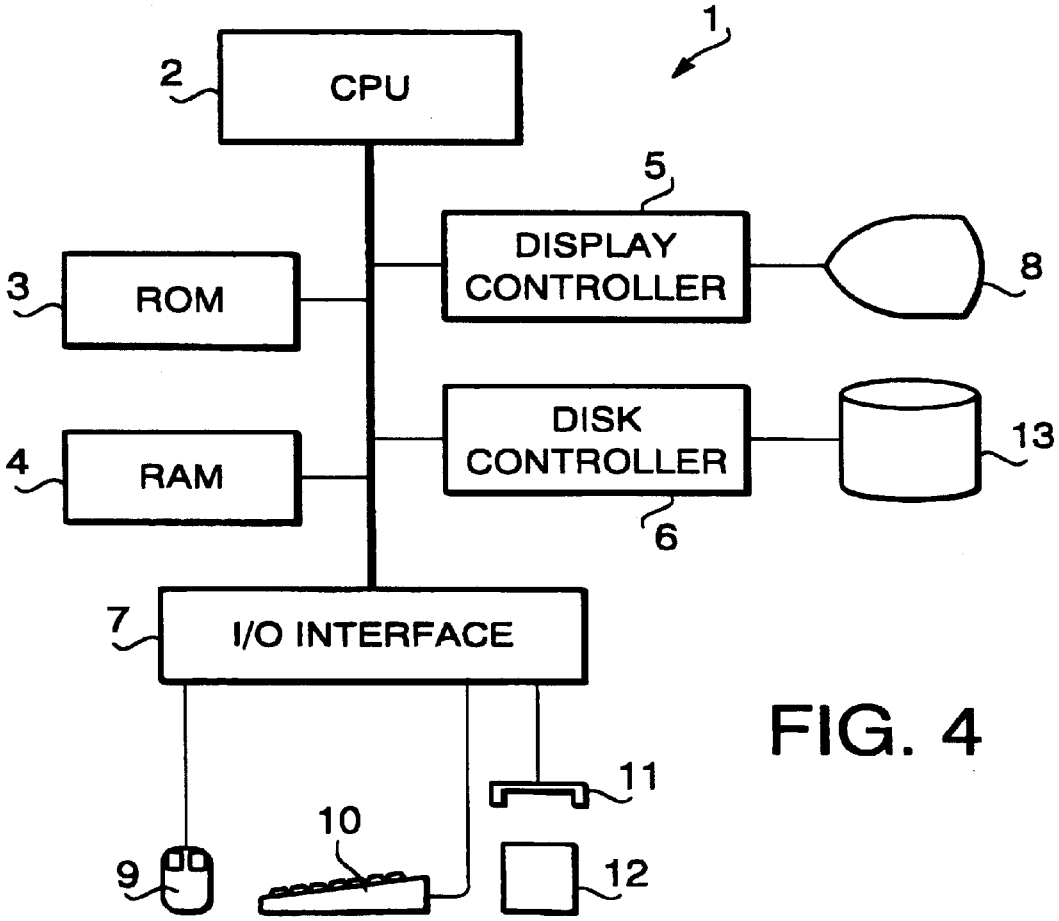
FIG. 4

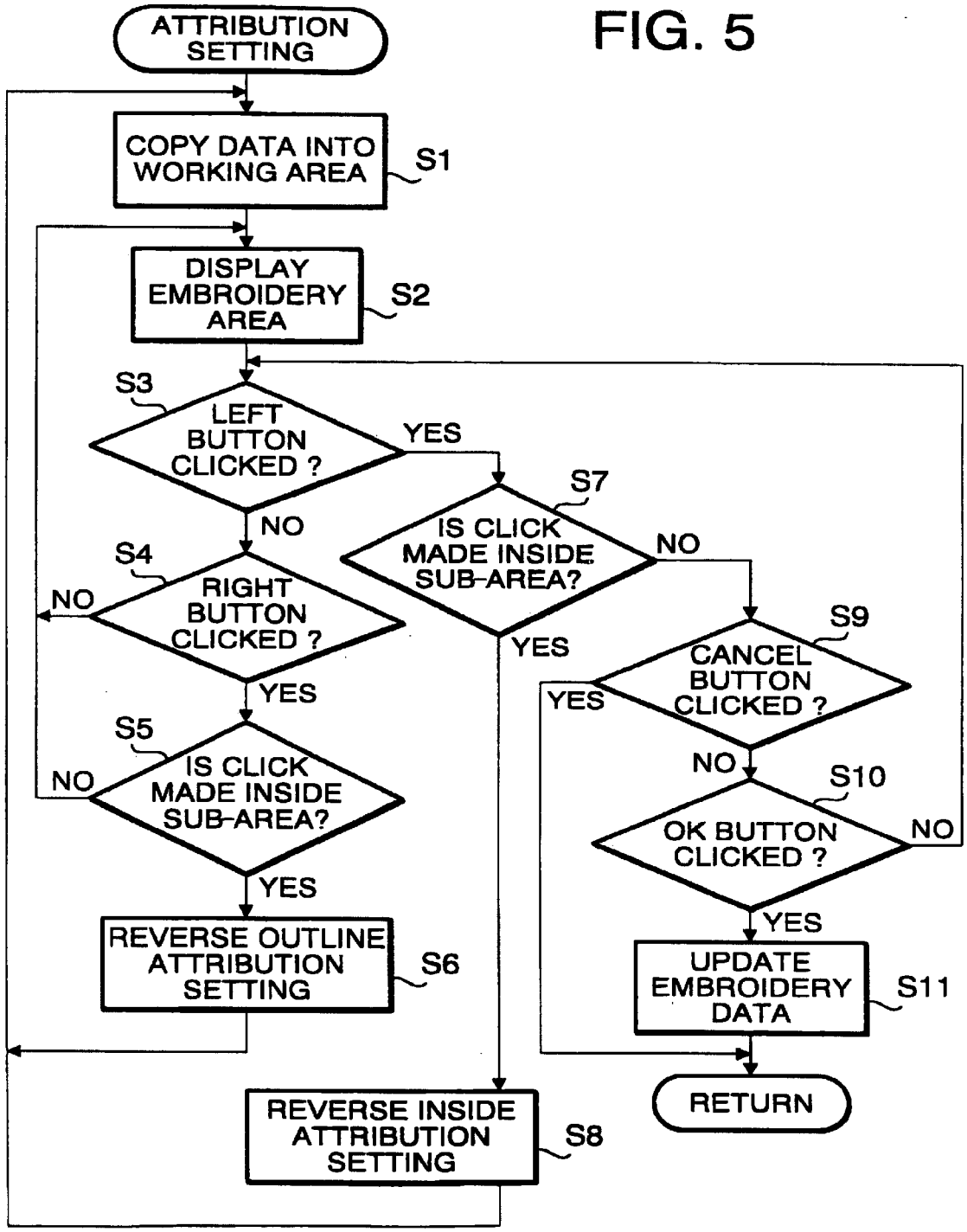
FIG. 5
ATTRIBUTION SETTING
COPY DATA INTO WORKING AREA
S1
DISPLAY EMBROIDERY AREA
S2
S3
LEFT BUTTON CLICKED ?
YES
NO
S4
RIGHT BUTTON CLICKED ?
NO
YES
S5
IS CLICK MADE INSIDE SUB-AREA?
NO
YES
REVERSE OUTLINE ATTRIBUTION SETTING
S6
S7
IS CLICK MADE INSIDE SUB-AREA?
NO
YES
REVERSE INSIDE ATTRIBUTION SETTING
S8
S9
CANCEL BUTTON CLICKED ?
YES
NO
S10
OK BUTTON CLICKED ?
NO
YES
UPDATE EMBROIDERY DATA
S11
RETURN

EMBROIDERY DATA PROCESSING DEVICE

BACKGROUND OF THE INVENTION

The present invention relates to an embroidery data processing device for processing embroidery data to assign a sewing attribution to sub-areas included in an embroidery area.

Conventionally, in the field of industrial sewing machines, an embroidery data processing device which is provided with a micro-computer and is capable of processing embroidery data having high precision within a relatively short period of time is known. In such an embroidery data processing device, when embroidery data is generated based on an original picture pattern (i.e., a desired image), the following processing is executed.

Firstly, the original picture pattern is divided into groups having the same colors, and the embroidery data is created such that the areas having the same color are embroidered successively. The picture pattern for the embroidery data is input in the processing device by tracing the original with use of a tablet. Alternatively, the original may be scanned by a scanner, displayed on a monitor device, and then the displayed image is traced with a mouse.

If the embroidery area is a linear area extending as a thin elongated path, a zigzag stitch or a line stitch is assigned to the area; and if the area is a two-dimensional area having a certain area, a satin stitch or a Tatami stitch is assigned to the area.

Creation of the embroidery data according to a conventional method is described in more detail with reference to FIG. 1. In this example, the original picture pattern has six embroidery areas R0–R5, and the following attribution is assigned to each area.

R0; a red thread, a Tatami stitch;

R1: a black thread, a satin stitch;

R2: a yellow thread, a satin stitch;

R3: a green thread, a Tatami stitch;

R4: a green thread, a Tatami stitch; and

R5: a black thread, a zigzag stitch.

Setting for embroidery areas is performed such that a sewing attribution is determined first, and then an outline of an embroidery area to which the determined attribution is assigned is input by tracing a path through the tablet or the mouse as described above. The input embroidery areas are displayed as a color image on a display of the data processing device, as shown in FIG. 2.

When certain areas (secondary areas) are included (i.e., to be overlapped) in another area (first area), it should be determined that which sewing attribution is to be assigned to the areas which are parts of the first area and corresponding to the secondary areas. It should be noted that the areas R1 and R2 are embroidery areas to be formed on the area R0. These areas (i.e., the areas R1 and R2) are referred to as the secondary areas). Portions of the area R0 on which the embroidery areas R1 and R2 are to be formed are referred to as sub-areas. The sub-areas are formed as parts of the area R0.

In the example of FIG. 2, since the areas R1 and R2 are located (i.e., to be overlapped) inside the area R0, the sub-areas corresponding to the areas R1 and R2 may be formed to be blank portions, or portions having the same sewing attribution as the other portion of the area R0. In other words, the sub-areas corresponding to the areas R1 and R2 may be filled, when embroidered, with a red thread, in Tatami stitches, or may be formed to be a blank portion having no stitch.

When the attribution is assigned to the sub-areas, it should be ensured that the areas R0, R1 and R2 are embroidered in an appropriate order. In the above example, the area R0 is embroidered first, followed by area R1 and then area R2. If the sub-area corresponding to the area R1 should be formed as a blank portion (i.e., no stitching is performed for the sub-area), since the areas R1 and R2 are formed after the area R0 is formed, the areas R1 and R2 will not be deformed or hidden by the area R0.

In other words, if the area R2 is formed before the area R0, and if the sub-area corresponding to the area R2 is not a blank portion, the area R2 is covered by the area R0. Therefore, in order to obtain an intended effect, the area R2 should be formed after the area R0 is formed, and in such a case, the area R2 may be formed to have a stand-out effect, or three-dimensional effect.

Conventionally, in order to generate the embroidery data defining such filled-in and blank portions, a first outline of an entire figure, and one or more second outlines of sub-area(s) inside the entire figure are designated. Then, the area between the first and second outlines are defined as the filled-in (embroidered) portion.

In the example of FIG. 1, the line L0, which is the first outline, and the line L1, which is the second outline, are designated, and then the area between the lines L0 and L1 is defined as the filled-in area.

In accordance with the conventional method described above, in order to switch a sub-area to be formed as the blank portion, i.e., to change a combination of the first outline and the second outline, it is necessary to release the combination having already been defined, and then another combination of the first and second outlines is determined. If changing of the blank portions (i.e., the combination of the first and second outlines) are to be executed relatively frequently, operation becomes very troublesome since the combination previously defined should be released every time the change is made. Further, it is very difficult to identify which sewing attribution is assigned to a sub-area from a displayed image.

SUMMARY OF THE INVENTION

It is therefore an object of the invention to provide an improved embroidery data processing device which is capable of changing attributions of blank portions, and further easy for an operator to identify and/or change filled-in and blank portions of an embroidery.

For the object, according to the invention, there is provided a method of editing embroidery data indicative of an embroidery area, at least one sub-area being included inside the embroidery area, another embroidery pattern being formed on the at least one sub-area, the method comprising the steps of: displaying an embroidery area, which is designated by an operator, together with the at least one sub-area included in the embroidery area; changing a displayed condition of the at least one sub-area when the at least one sub-area is designated, on the screen, by the operator, the displayed condition including at least two distinct displayed conditions respectively corresponding to different sewing conditions assigned to the at least one sub-area.

Thus, the sub-areas are displayed in different conditions in accordance with the sewing conditions assigned thereto. The sewing condition of the sub-areas can be switched only by designating the sub-area on the display, and the changed sewing condition is reflected on the display. The operator can recognize the current sewing condition assigned to the sub-area only by viewing the displayed image.

Optionally, the at least two distinct displayed conditions may include different patterns displayed on the screen. Even if the display displays only a monochrome image, difference of the sewing condition can be distinguished by the displayed patterns, such as hatching patterns. Alternatively, the sewing condition can be indicated by color if the color display is used.

If the sub-area has the same sewing condition as the main embroidery area has, the sub-area may be displayed to have the same displayed condition on the display.

Further optionally, the different sewing conditions assigned to the at least one sub-area may include a condition in which the sub-area is formed as a blank area where no stitch is formed. Alternatively or optionally, the different sewing conditions assigned to the at least one sub-area may include a condition in which the sub-area is formed as a filled-in area where the at least one sub-area is filled in with a certain embroidery pattern. Still alternatively or optionally, the different sewing conditions assigned to the at least one sub-area include a condition in which an outline of the sub-area is embroidered.

It is preferable that the method includes a step of confirming whether changes are to be reflected to the embroidery data. Further, the method may include a step of updating the embroidery data when changes having made are confirmed at the confirming step. Then, the original embroidery data is updated only when the operator confirms that the change is intended.

Alternatively or optionally, the method may include a step of canceling changes having been made by changing the displayed condition of the at least one sub-area. In this case, if the operator does not wish to update the original data, the change can be canceled.

Further optionally, the method may comprise a step of generating a sewing data based on the embroidery data, the sewing data being stored in a recording medium which is readable by a sewing machine.

According to another aspect of the invention, there is provided an embroidery data processing device for editing embroidery data indicative of an embroidering area, at least one sub-area being included inside the embroidering area, an embroidering pattern being formed on the embroidering area, another embroidery pattern being formed on the at least one sub-area, the embroidery data processing device comprising: means for displaying an embroidery area, which is designated by an operator, together with the at least one sub-area included in the embroidery area; and means for changing a displayed condition of the at least one sub-area when the at least one sub-area is designated, on a screen, by the operator, the displayed condition including at least two distinct displayed conditions respectively corresponding to different sewing conditions assigned to the at least one sub-area.

According to a further aspect of the invention, there is provided an embroidery data processing device for editing embroidery data indicative of an embroidery area, at least one sub-area being included inside the embroidering area, another embroidery pattern being formed on the at least one sub-area, the embroidery data processing device comprising: an embroidery data memory which stores the embroidery data; a display, which displays an image of the embroidery area together with the at least one sub-area included in the embroidery area; a designating system which is operable by an operator to designate a sub-area displayed on the display; a controller which switches displayed condition of the sub-area designated with use of the designating system, the displayed condition including at least two distinct displayed conditions respectively corresponding to different sewing conditions assigned to the at least one sub-area.

With this embroidery data processing device, the sub-areas are displayed in different conditions in accordance with the sewing conditions assigned thereto. The sewing condition of the sub-areas can be switched only by designating the sub-area on the display, and the changed sewing condition is reflected on the display. The operator can recognize the current sewing condition assigned to the sub-area only by viewing the displayed image.

BRIEF DESCRIPTION OF THE DRAWINGS

FIG. 3 is a schematic perspective view of the embroidery data processing device according to an embodiment of the invention;

FIG. 4 is a block diagram illustrating a control system of the embroidery data processing device;

FIG. 5 is a flowchart illustrating attribution setting process;

DETAILED DESCRIPTION OF THE PREFERRED EMBODIMENTS

Figure 1:
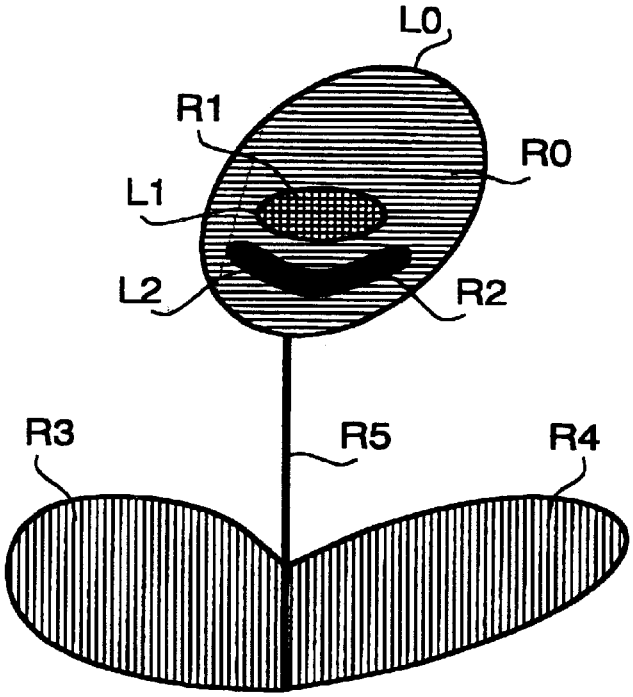
FIG. 1 shows an example of embroidery areas to be processed.

An embodiment of the present invention will be described with reference to accompanying drawings. It should be noted that FIG. 1 is referred to when the conventional art is described, and the same drawing will be referred to when the embodiment according to the present invention is described.

Firstly, a personal embroidery sewing machine will be described briefly. The embroidery sewing machine is provided with a frame for supporting a cloth on which the embroidery is formed. The frame is located on a sewing machine bed, and movable in X and Y directions which are perpendicular to each other, and are also perpendicular to moving direction of a needle of the sewing machine. By a moving mechanism, the frame is moved in the X and Y directions while sewing is executed, an two-dimensional pattern is formed on the cloth.

Generally, the moving mechanism and the needle are controlled to move by a controller which is provided in the sewing machine. Specifically, in accordance with position data of each X and Y stitch, the controller controls the movement of the frame and the needle so that the pattern represented by the data is formed.

The sewing machine is further provided with a flash memory reading device, and capable of reading embroidery data stored in the flash memory. In the embodiment described below, the data to be stored, for example, in the flash memory described above is created.

FIG. 3 shows a schematic perspective view of an embroidery data processing device, and FIG. 4 is a block diagram illustrating a control system of the embroidery data processing device.

The embroidery data processing device 100 has a main body which includes a personal computer having a CPU (Central Processing Unit) 2, a ROM (Read Only Memory) 3, a RAM (Random Access Memory) 4, a display controller 5, a disk controller 6, and an I/O interface 7. The above listed units are all interconnected through a system bus.

The display controller 5 is connected to a displaying device such as a CRT (Cathode Ray Tube) 8 for displaying embroidering patterns, various messages and the like.

The interface 7 is connected to a mouse 9 which is operated by an operator to input a shape of a pattern, various control commands and the like, and a keyboard 10 which is used for inputting alphanumeric characters, operation commands and the like. Further, the interface 7 is connected with a card connector 11 to which a card-shaped flash memory 12 is connected. The flash memory 12 is used for storing the embroidery data processed by the embroidery data processing device.

The disk controller 6 is connected to a hard disk drive 13 which stores programs to be executed by the CPU 2 for operating embroidery data processing, newly created embroidery data and the like.

When the embroidery data processing device is turned ON, a program loader stored in the ROM 3 controls the disk controller 6 to load the programs stored in the hard disk drive 13 into the RAM 4. Then the CPU 2 is ready to execute the loaded programs to perform various embroidery data processing.

In the following description, the embroidery data processing operation is described when embroidery data for the "flower" shown in FIG. 1 is processed, with reference to a flowchart shown in FIG. 5. It is assumed that the embroidery data representing the figure (i.e., the flower) shown in FIG. 1 has been stored in a predetermined area of the RAM 4 as input through the mouse 9, keyboard 10, or from the hard disk drive 13.

Figure 6:
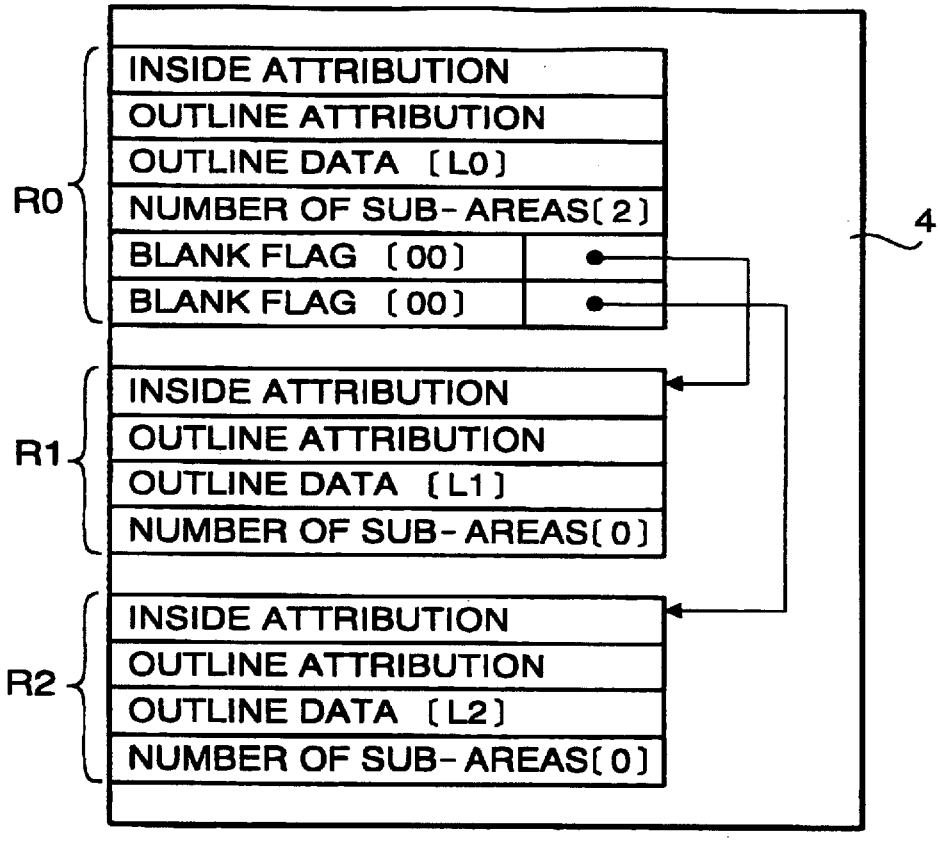
FIG. 6 shows a format of the embroidery data.

FIG. 6 shows a table representing a data structure of the embroidery data for the pattern (i.e., the flower) shown in FIG. 1. Note that in the table shown in FIG. 6, only data related to the areas R0–R2 are shown in order for simplifying description, and in practice, data for the areas R3–R5 should be included.

The embroidery data shown in FIG. 6 includes inside attribution data, outline attribution data, outline data, the number of sub-areas, the blank flags respectively corresponding to each of the sub-areas and pointers indicative of the data the sub-areas.

The inside attribution data defines a type of stitch applied to the inner area, and includes a color of thread, a type of stitch (e.g., a satin stitch, a Tatami stitch or the like), a density of stitch, a pitch of stitch, a direction of stitch and the like.

The outline attribution data defines a type of stitch applied to form the outline of the area, and may include a color of a thread, a type of stitch (e.g., a running stitch, a zigzag stitch or the like), a density of stitch, a pitch of stitch, or the like.

The outline data indicates the shape of the area, and includes an array of the number of apexes defining the outer shape, and coordinates of the apexes in relation to the frame of the sewing machine.

The pointers indicate another area data which corresponds to the sub-areas to be overlapped on the areas, respectively.

The blank flag indicates whether the sub-area is formed to be a blank area. Specifically, the blank flag is a two-bit data, and [00] indicates that the sub-area is to be formed as a blank area and no outline stitch is formed; [01] indicates that the sub-area is to be formed as a blank area and the outline stitch is formed; [10] indicates that the sub-area is an embroidered area, and no outline stitch is formed; and [11] indicates that the sub-area is an embroidered area, and the outline stitch is formed.

The initial value of the blank flag is [00], i.e., the area is formed to be a blank area and no outline stitch is sewn.

When data processing is executed, firstly, the operator is required to change an operation mode to a attribution setting mode. To enter this mode, the operator selects an area, of which the operator intends to change the attribution of the sub-areas, on the displaying device 8, and then inputs a command through the keyboard 10. In order to change the setting related to the sub-areas, the selected area should include at least one sub-area.

In the example of FIG. 1, attribution of the sub-areas included in the area R0 is to be changed, and therefore the area R0 is selected and the operation mode is changed to the attribution setting mode.

Figure 2:
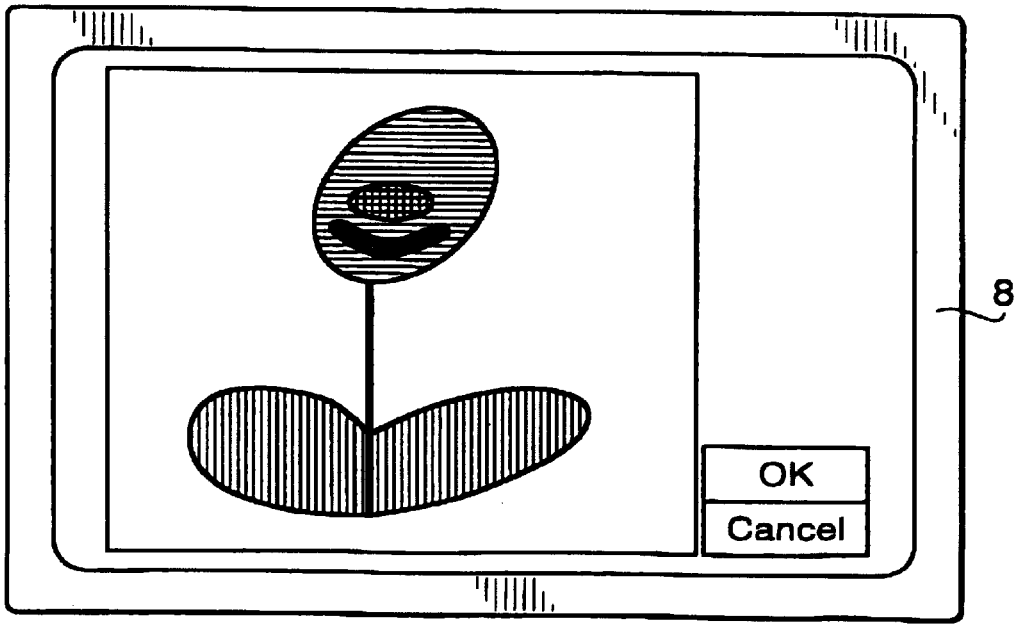
FIG. 2 shows a screen image of a displaying device of the embroidery processing device.

Then, among the data shown in FIG. 6, data of the area R0 is copied into a working area of the RAM 4 (S1). Note that change of the data will be applied to the copied data first, and after the changes are confirmed by the operator, the changes are reflected to the original data, i.e., the data stored in the predetermined area of the RAM 4. Specifically, as shown in FIG. 2, an OK button and a CANCEL button are displayed on the displaying device 8. In an initialization process which is executed when the operation mode is changed to the attribution setting mode, the OK button and CANCEL button are displayed. By moving a mouse pointer with use of the mouse, and clicking the mouse button when the mouse pointer is displayed on the OK or CANCEL button, the operator can send OK command or CANCEL command to the CPU 2. Hereinafter, the operation of moving the mouse pointer on the display and clicking the mouse button when the mouse pointer is displayed at a certain point will be referred to as "click the point." For example, when it is described that the operator clicks the OK button, it means the operator moves the mouse pointer on the display with use of the mouse, and clicks the mouse button.

In S2, the area to be processed is displayed on a screen of the displaying device 8. At this stage, inside the area R0 is drawn to have a color similar to the color of the thread indicated in the table shown in FIG. 6. Further, the blank flags for the sub-areas are referred to. If the blank flag for each sub-area is set such that the area is to be filled in, the area is drawn to have the same color as the area R0. If the blank flag for the sub-area is set such that the sub-area is a blank area, the sub-area is drawn such that the color of the area is not the same as the color of the area R0 but has the same color as the background of the screen of the displaying device 8.

Similarly, if the blank flag is set such that the sub-area has the outline stitch, the sub-area is displayed to have the outline having a predetermined color of the thread for the outline stitch. If the outline is not to be formed, no outline is displayed on the screen of the displaying device 8.

Figure 7:
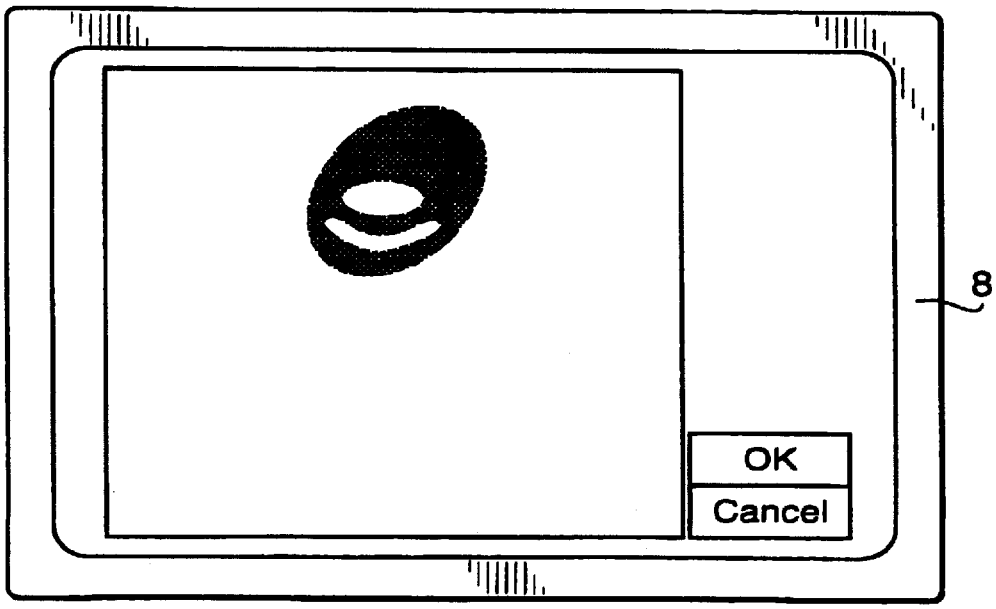
FIG. 7 is another screen image of the displaying device.

In the example shown in FIG. 6, both of the blank flags are set as [00], the area R0 is displayed on the screen of the displaying device 8 as shown in FIG. 7.

Since the area R0 has the attribution data indicating the red thread, and Tatami stitch, the area R0 is displayed in red. In this example, it is assumed that the outline attribution of the area R0 is [a black thread, and a zigzag stitch].

In the following steps, until the mouse button is clicked (S3:NO and S4:NO), data processing for the displayed area R0 is not performed, and accordingly the same image is kept displayed on the screen of the displaying device 8.

In this example, the area corresponding to the area R1 is changed to have an outline, and the area corresponding to the R2 is changed to a filled-in area.

Firstly, on the screen of the displaying device 8, the area R2 is clicked with a left mouse button (S3:YES). Then, control goes to S7, and further to S8 since the area R2 is a sub-area.

At S8, the blank flag corresponding to the area R2 is changed from [00] to [01], i.e., the bit indicative of the blank area is reversed to indicates the filled-in area. After S8, control goes to S2, at which, since the blank flag has been changed as described above, the area is drawn to have the color similar to the color inside the area R0. Thus, attribution of the sub-area corresponding to the area R2 is changed to the filled-in area, which can be visually recognized easily.

Next, on the screen of the displaying device 8, the area R1 is clicked with a right mouse button (S3:NO; S4:YES). Then control goes to S5, and further goes to S6 since the area R1 is a sub-area.

Figure 8:
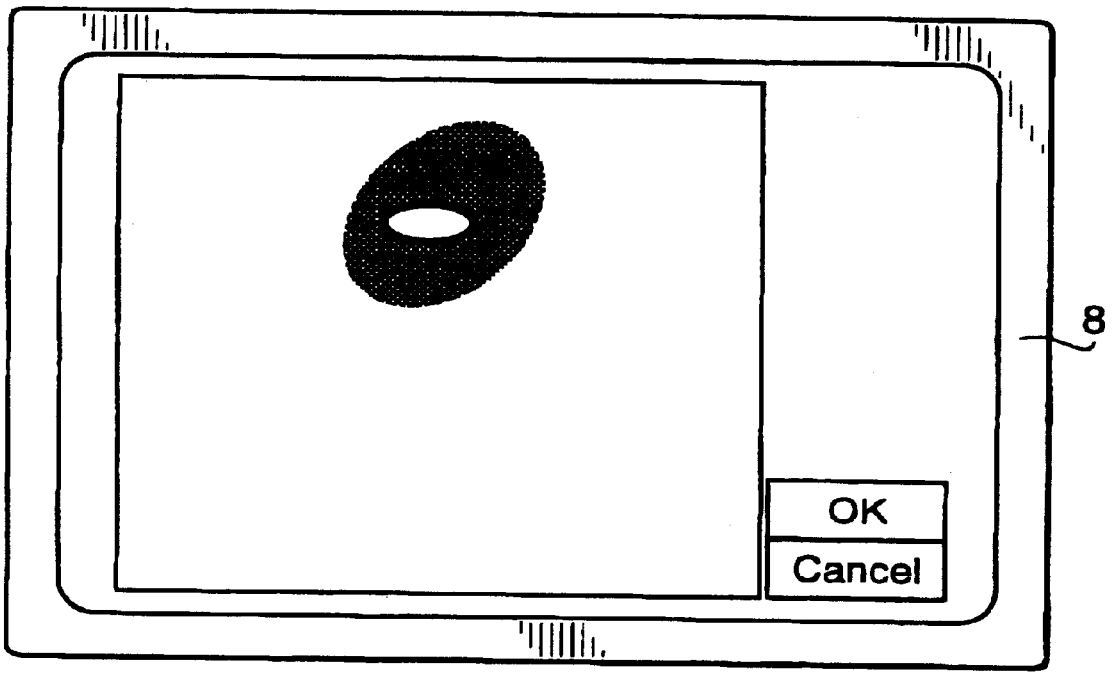
FIG. 8 is still another screen image of the displaying device.

At S6, the blank flag of the sub-area corresponding to the area R1 is changed from [00] to [10], i.e., the bit related to the outline stitch is reversed to indicate that the outline stitch is to be formed. After S6, control goes to S2 at which, since the blank flag has been changed as described above, the area corresponding to the area R1 is drawn to have the outline with the color indicative of the outline as shown in FIG. 8. Thus, changing of the attribution of the sub-area corresponding to the area R1 can be visually recognized easily.

In this example, only two sub-areas are included in the area R0, and the attribution of the sub-areas have been changed. Even if there are more number of sub-areas, the similar process can be repeated to change the attribution, and displayed condition on the screen of the displaying device 8.

If a sub-area of which attribution has been changed to a filled-in area is clicked with the left mouse button, the attribution is changed again from the filled-in area to the blank area. As derived from the flowchart and the description above, when the blank flag is changed, the displayed image reflects the change of the flag immediately.

After the attribution settings have been changed as described above, the operator clicks the OK button on the screen of the displaying device 8 (S10:YES) to confirm the change. Then, control goes to S11 and the embroidery data stored in the predetermined area is updated with the changed data stored in the working area, i.e., the changed data stored in the working area overwrites the data stored in the predetermined area of the RAM 4.

After the embroidery data has been updated, the OK and CANCEL buttons on the screen disappear, the attribution setting mode is released, and the updated settings become effective.

It should be noted that if the CANCEL button is clicked instead of the OK button after the settings have been changed (S9:YES), the data stored in the working area is disregarded, and the data stored in the predetermined area is not updated. Thus, the settings before the attribution setting mode operation is executed are maintained.

In accordance with a predetermined process, the embroidery data edited as above is converted into sewing data, which can be read by a sewing machine, including the stitch data, color data, thread exchange data, list of coordinates of stitching points and the like, and then the sewing data is stored in the flash memory 12. It should be noted that when the data conversion is carried out, the blank flags are referred to and are taken into account. Conversion of the embroidery data into the sewing data is well known, and an example of such a conversion is disclosed in Japan Patent Publication No. SHO 60-42740.

If the flash memory 12 storing the sewing data is inserted in a sewing machine, the embroidery as shown in FIG. 1 and having attribution as described above is formed.

According to the embroidery data processing device described above, attribution setting of sub-areas can be changed easily only by clicking the sub-areas with use of a mouse. Thus, it is unnecessary to designate a combination of outlines defining the filled-in areas, release the previous combination of the outlines, and define a new combination of outlines.

In the above-described embodiment, the displaying device displays a color image. If a monochrome display such as a monochrome LCD (Liquid Crystal Display) or the like is used as a displaying device, the embroidery areas, and sub-areas having different sewing attribution assigned may be displayed to have different hatching patterns and/or gradation levels.

In the above-described embodiment, as a recording medium for storing the sewing data, the flash memory is used. However, it is not limited to this example, and an alternative medium, such as a floppy disk can also be used. Further, instead of using a recording medium, a communication system (either wired or wireless) can also be used for transmitting the sewing data from the embroidery data processing device to the sewing machine. Furthermore, format of the embroidery data is not limited to the above-described one, but any type of data, as far as the embroidery areas and the sub-areas can be distinguished, can be used by modifying the process described herein.

Although the data processing device is described as a device separate from a sewing machine, it is also possible to incorporate the data processing device in a sewing machine.

The present disclosure relates to subject matter contained in Japanese Patent Application No. HEI 8-268302, filed on Oct. 9, 1996, which is expressly incorporated herein by reference in its entirety.

What is claimed is:

1. A method of editing embroidery data indicative of an embroidering area, at least one sub-area being included inside said embroidering area, an embroidering pattern being formed on said embroidering area, another embroidery pattern being formed on said at least one sub-area, said method comprising the steps of:

displaying an embroidery area, which is designated by an operator, together with said at least one sub-area included in said embroidery area; and changing a displayed condition of said at least one sub-area when said at least one sub-area is designated, on a screen, by the operator, said displayed condition including at least two distinct displayed conditions respectively corresponding to different sewing conditions assigned to said at least one sub-area.

2. The method according to claim 1, wherein said at least two distinct displayed conditions include different patterns displayed on said screen.

3. The method according to claim 1, wherein said at least two distinct displayed conditions include different colors.

4. The method according to claim 1, wherein said at least two distinct displayed conditions include difference in at least one of displayed pattern and displayed color.

5. The method according to claim 1, wherein one of said at least two distinct displayed conditions is similar to a displayed condition of said embroidery area.

6. The method according to claim 1, wherein said different sewing conditions assigned to said at least one sub-area include a condition in which said sub-area is formed as a blank area where no stitch is formed.

7. The method according to claim 1, wherein said different sewing conditions assigned to said at least one sub-area include a condition in which said sub-area is formed as a filled-in area where said at least one sub-area is filled in with a certain embroidery pattern.

8. The method according to claim 1, wherein said different sewing conditions assigned to said at least one sub-area include a condition in which an outline of said sub-area is embroidered.

9. The method according to claim 1, further comprising a step of confirming whether changes are to be reflected to said embroidery data.

10. The method according to claim 9, further comprising a step of updating said embroidery data when changes having been made are confirmed at said confirming step.

11. The method according to claim 9, further comprising a step of canceling changes having been made by changing the displayed condition of said at least one sub-area.

12. The method according to claim 10, further comprising a step of generating sewing data based on said embroidery data, said sewing data being stored in a recording medium which is readable by a sewing machine.

13. An embroidery data processing device for editing embroidery data indicative of an embroidering area, at least one sub-area being included inside said embroidering area, an embroidering pattern being formed on said embroidering area, another embroidery pattern being formed on said at least one sub-area, said embroidery data processing device comprising:

means for displaying an embroidery area, which is designated by an operator, together with said at least one sub-area included in said embroidery area; and means for changing a displayed condition of said at least one sub-area when said at least one sub-area is designated, on a screen, by the operator, said displayed condition including at least two distinct displayed conditions respectively corresponding to different sewing conditions assigned to said at least one sub-area.

14. An embroidery data processing device for editing embroidery data indicative of an embroidering area, at least one sub-area being included inside said embroidering area, another embroidery pattern being formed on said at least one sub-area, said embroidery data processing device comprising:

an embroidery data memory which stores said embroidery data;

a display, which displays an image of said embroidery area together with said at least one sub-area included in said embroidery area;

a designating system which is operable by an operator to designate a sub-area displayed on said display;

a controller which switches a displayed condition of said sub-area designated with use of said designating system, said displayed condition including at least two distinct displayed conditions respectively corresponding to different sewing conditions assigned to said at least one sub-area.

15. The embroidery data processing device according to claim 14, wherein said at least two distinct displayed conditions include difference in at least one of displayed pattern and displayed color.

16. The embroidery data processing device according to claim 14, wherein one of said at least two distinct displayed conditions is similar to a displayed condition of said embroidery area.

17. The embroidery data processing device according to claim 14, wherein said different sewing conditions assigned to said at least one sub-area include a condition in which said sub-area is formed as a blank area where no stitch is formed.

18. The embroidery data processing device according to claim 14, wherein said different sewing conditions assigned to said at least one sub-area include a condition in which said sub-area is formed as a filled-in area where said at least one sub-area is filled in with a certain embroidery pattern.

19. The embroidery data processing device according to claim 14, wherein said different sewing conditions assigned to said at least one sub-area include a condition in which an outline of said sub-area is embroidered.

20. The embroidery data processing device according to claim 14, further comprising a data generating system which generates, in accordance with said embroidery data, sewing data to be read by a sewing machine.

* * * * *